US011878885B2

(12) United States Patent
Dettori et al.

(10) Patent No.: US 11,878,885 B2
(45) Date of Patent: Jan. 23, 2024

(54) DEVICE FOR LOADING ROLLSON A MACHINE COMPRISING SAID DEVICE

(71) Applicant: MAXIMA S.R.L., Lucca (IT)

(72) Inventors: Daniele Dettori, Capannori (IT); Gionata Pardini, Viareggio (IT)

(73) Assignee: MAXIMA S.R.L.

( * ) Notice: Subject to any disclaimer, the term of this patent is extended or adjusted under 35 U.S.C. 154(b) by 478 days.

(21) Appl. No.: 17/258,681

(22) PCT Filed: Jul. 9, 2019

(86) PCT No.: PCT/EP2019/068423
§ 371 (c)(1),
(2) Date: Jan. 7, 2021

(87) PCT Pub. No.: WO2020/011792
PCT Pub. Date: Jan. 16, 2020

(65) Prior Publication Data

US 2021/0284474 A1 Sep. 16, 2021

(30) Foreign Application Priority Data

Jul. 10, 2018 (IT) ..... 102018000007089

(51) Int. Cl.
*B65H 19/29* (2006.01)
*B65H 19/30* (2006.01)

(52) U.S. Cl.
CPC ..... *B65H 19/29* (2013.01); *B65H 19/30* (2013.01); *B65H 2301/414446* (2013.01); *B65H 2511/14* (2013.01)

(58) Field of Classification Search
CPC ..... B65H 19/29; B65H 19/30; B65H 2301/414446; B65H 2511/14
See application file for complete search history.

(56) References Cited

U.S. PATENT DOCUMENTS 5,573,615 A * 11/1996 Vigneau ..... B65H 19/29 156/184
9,434,140 B2 * 9/2016 Ghiselli ..... B32B 37/20
9,744,751 B2 * 8/2017 Ghiselli ..... B65H 19/29
(Continued)

FOREIGN PATENT DOCUMENTS

DE 10 2014 103956 A1 9/2015
FR 2 971 778 A1 8/2012
GB 1 031 334 A 6/1966

OTHER PUBLICATIONS

Bibliographic data including English Abstract for DE 10 2014 103956 A1, Foreign Patent Document Cite No. 1, 2 pages.
(Continued)

*Primary Examiner* — Sang K Kim
(74) *Attorney, Agent, or Firm* — Ware, Fressola, Maguire & Barber LLP

(57) ABSTRACT

A device (5) for loading rolls (R) in a machine (1) includes a rotating member (6) that rotates around an axis (A) of rotation and having a plurality of radial elements (17A, 17B, 17C, 17D; 17E) spaced angularly with respect to each other. The radial elements define receiving seats (16) for rolls. At least one of the receiving seats (16) is suitable for assuming at least two distinct configurations for receiving and handling rolls (R) of different radial dimensions.

14 Claims, 11 Drawing Sheets

(56) References Cited

U.S. PATENT DOCUMENTS

| | | | | |
|---|---|---|---|---|
| 2015/0013887 | A1* | 1/2015 | Ghiselli | B32B 37/0053 156/535 |
| 2015/0020976 | A1* | 1/2015 | Yen | B65H 19/29 156/361 |
| 2015/0191325 | A1* | 7/2015 | Mazzaccherini | B65H 19/29 156/357 |
| 2016/0221029 | A1* | 8/2016 | Gambini | B65H 23/02 |
| 2016/0236453 | A1* | 8/2016 | Ghiselli | B65H 75/28 |
| 2016/0236886 | A1* | 8/2016 | Strain | B65H 19/29 |
| 2017/0210585 | A1* | 7/2017 | Dettori | B65H 19/2246 |
| 2018/0029817 | A1* | 2/2018 | Strain | B65H 19/29 |

OTHER PUBLICATIONS

Bibliographic data including English Abstract for FR 2 971 778 A1, Foreign Patent Document Cite No. 2, 2 pages.

International Search Report and Written Opinion of the International Searching Authority (ISA/EP), Application No. PCT/EP2019/068423, dated Sep. 30, 2019, 11 pages.

* cited by examiner

DEVICE FOR LOADING ROLLSON A MACHINE COMPRISING SAID DEVICE

TECHNICAL FIELD

The present invention relates to machines and devices for making and handling rolls, particularly tissue paper rolls, such as toilet rolls or tissue paper in general.

BACKGROUND OF THE INVENTION

In the production field of tissue paper rolls it is common to transform one or more reels of cellulose webs into rolls of smaller diametral size, comprising a web material composed of one or more tissue paper webs joined together, for example by gluing. The transformation process includes the work of one or more machines operating in series. For example, the rolls are wound by means of a so-called rewinding machine at the exit of which the rolls are unloaded, usually with the free edge of the material with open configuration tape. The free edge must be glued to the cylindrical surface of the roll to close the roll and prevent it from unwinding, even partially, thus creating a hindrance to subsequent packaging operations.

For this purpose, there are known machines for closing the free edge, sometimes called with the Anglo-Saxon term "tail sealer". In order to harmonize the production process between one machine and the other it is necessary for the rolls to be singularly fed within the closing free edge machine, that is, one at a time, with a frequency consistent with its production rate, while upstream the possibility of accumulating the rolls must be guaranteed, thus respecting the production rate of the rewinding machine.

For this purpose, at the inlet of the free edge closing machine there is a rotating distributor, sometimes also called "butterfly", which has a plurality of rolls' receiving seats, which are commonly of the same shape and said rotating distributor rotates around an axis of rotation parallel to rolls axis and orthogonal to roll advancement path through the machine. Each seat hosts a single roll and the distributor rotation allows a roll at a time to be transferred towards the gluing station. The seats consist of rotating arms with an approximately radial development.

Devices of this type have the disadvantage of being unable to work with whatever diameter of rolls. In fact, the radial dimension of the rotating arms is correlated to the size of rolls. The larger is the roll diameter, the greater must be the radial arm size. Radial arms having sufficient length for handling large-diameter rolls cannot handle single small-diameter rolls since, at each rotation, the arms would press against the roll following the one in the seat of the distributor device, probably accumulated upstream.

Therefore, within production lines, when an extreme product flexibility is required and therefore there is a need to handle rolls of both small and large diameters, as in the so-called industrial rolls, it is necessary to use differently shaped distributors, such that it is not possible to have a plurality of identical elements and therefore are usually provided with an alternating motion. The latter have low productivity due to alternating rather than continuous motion. Low productivity is not a limit only when large-diameter rolls are handled, whose winding takes a long time, and therefore these rolls arrive at the distributor device at a low rate. Higher productivity of the device would be useless. However, when machines equipped with alternating motion devices have to work small diameter rolls, their reduced productivity penalizes the overall productivity of the line. In fact, rolls of small diameter could be produced with a rate higher than that which the device is able to provide. Consequently, the productivity of the rewinding machine is reduced with respect to its actual production capacity, due to the bottleneck constituted by the downstream machine, which contains the alternating motion device.

Similar problems can also arise in other types of machines, whenever it is necessary to distribute, ie load rolls singularly into or toward a station, group or processing unit, or more generally along an advancement path.

It would therefore be useful to have a roll loading device suitable to handle both small diameter rolls and large diameter rolls but without penalizing the productivity of the line.

SUMMARY OF THE INVENTION

To solve or alleviate the problems of the prior art, a device is proposed for loading rolls in a machine, said device comprising a rotating member around an axis of rotation, having a plurality of radial elements angularly spaced with respect to one another, which define locations for receiving the rolls. In some embodiments, at least one of said elements is able to assume at least two distinct angular positions with respect to the axis of rotation, to modify the geometry of the receiving seats for the rolls as a function of the diameter of the rolls.

In other embodiments, at least one of the radial elements can be easily replaced with an alternative radial element, of different shape, such that the receiving seat for the rolls formed by the replaceable radial element is different from the one formed by the alternative radial element. One of the seats is therefore optimized to handle variable rolls within a large diameter range (rolls of small and large diameter), while the other is optimized to work rolls within a limited range of diameter (substantially definable with small diameter).

In general, the device can be controlled by an electric motor or other actuator capable of selectively imparting continuous rotary motion or alternating rotary motion. The first will be used to handle rolls with the device configured with identical receiving seats (for rolls of small diameter), while the second one for handling rolls up to a large diameter with the new device configuration.

In this way the device motion is optimized according to the diameter of the rolls to be handled.

Within the scope of the present description and of the attached claims for "radial element" is meant an element which extends from the axis of rotation, but which can also be offset with respect to the said axis, that is, which can be fixed to a shaft rotating around the axis of rotation, in a offset manner with respect to the axis, so that the median axis of the radial element does not necessarily have to intersect the axis of rotation of the device. Moreover, as will become clear from the following description, the radial element can form an angle different from 90° with the axis of rotation, for example it can be inclined in the tangential direction. This can be useful, in particular, in the case of alternative radial elements, which are replaced when the device is to be configured for manipulating rolls of large diameter.

Further advantageous features and embodiments of the device according to the invention are indicated in the attached claims.

According to another aspect, the invention also relates to a machine comprising a feeding path for rolls from a path entry of the machine, characterized in that it comprises a device according to one or more of the preceding claims, positioned along the feeding path.

In some embodiments, the machine is a machine for closing the final edge of the rolls.

BRIEF DESCRIPTION OF THE DRAWINGS

The drawings show exemplary embodiments of the invention. More in particular:

FIGS. 3A, 3B show two different angular positions of the loading device in the configuration for handling rolls of large diameter;

DETAILED DESCRIPTION OF EMBODIMENTS OF THE INVENTION

In the following, a gluing or closing machine of the end edge of the rolls is described, which can be used in a roll production line, with a loading device according to the present invention. However, it must be understood that the device can also be used in other types of machines, where it is necessary to distribute rolls singularly along an advancement path.

Figure 1:
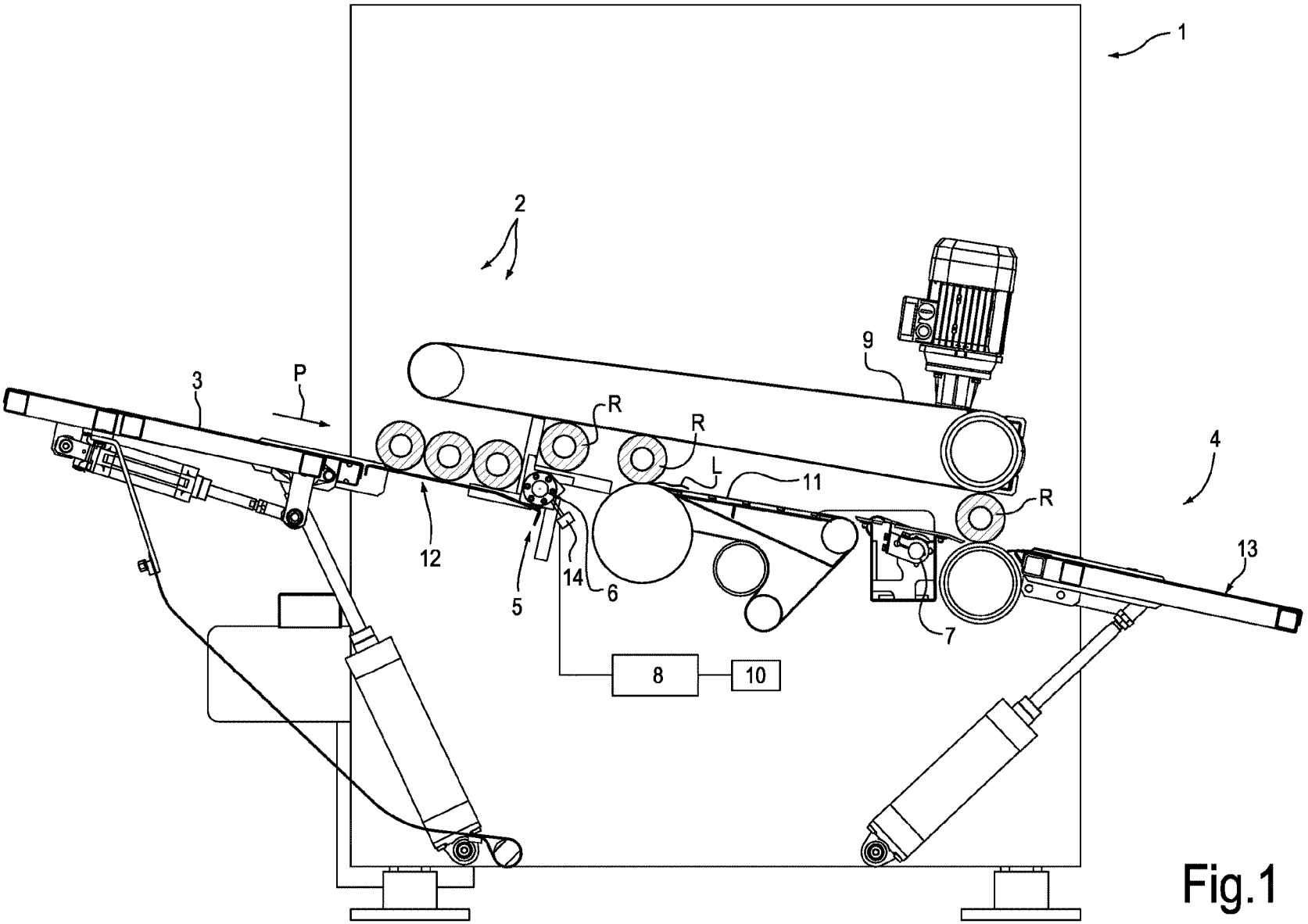
FIG. 1 shows a schematic side view of a machine for closing the free edge of rolls of tissue paper, comprising a device according to the invention.

FIG. 1 shows schematically a side view of the machine for closing the free edge of the rolls R. The machine is indicated as a whole with reference numeral 1. The machine has an inlet 2 and an outlet 4. At the inlet 2 are associated an input chute 3 and a loading device 5, which specifically forms the subject of the present invention. Letter P indicates the feeding path of advancement of the rolls R from the inlet 2 to the outlet 4. The loading device 5 comprises a rotating member 6.

Upstream of the loading device 5, with respect to the feeding direction of the rolls R, there is a storage area or accumulation zone 12, in which rolls R can accumulate waiting to be picked up and distributed by the loading device 5 (FIG. 1).

A gluing station 7 is arranged along the feeding path P, in addition to the loading device 5. An upper continuous flexible member 9 extends between the inlet 2 and the outlet 4, said flexible member 9 being spaced from an underlying lower continuous member 11. The feeding path P of the rolls R extends between the two continuous members 9, 11, with rolls R coming from the loading device 5 and which are forwarded towards the gluing station 7. The distance between the continuous members or organs 9, 11 is adjustable according to the diametrical dimension of the rolls R to be glued.

The structure of the machine 1 herein briefly described is known per se, see for example EP0541496.

Figure 2:
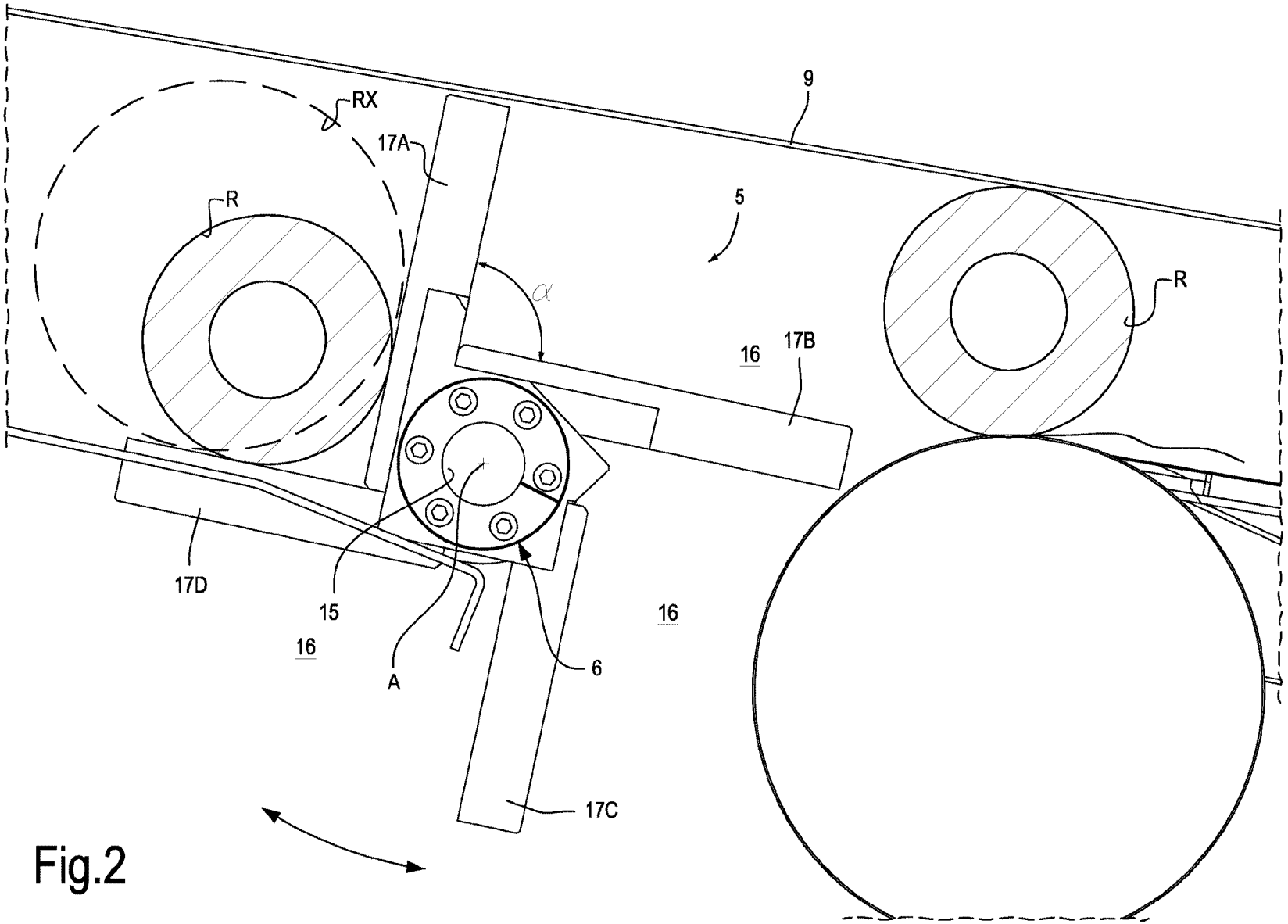
FIGS. 2 and 3A, 3B show two different configurations of the rotary loading device of FIG. 1 in a possible embodiment; in particular
Figure 3A:
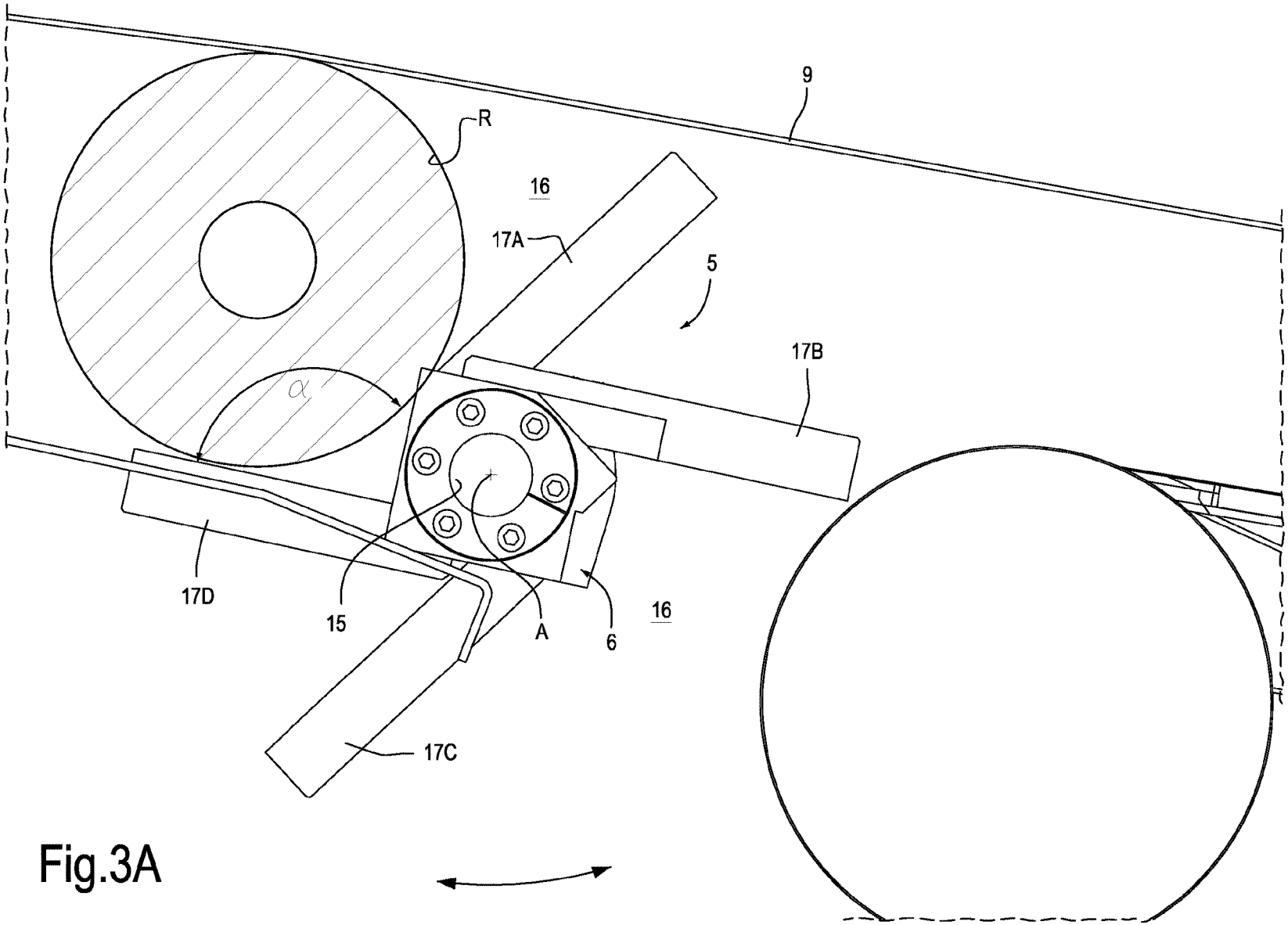
Figure 3B:
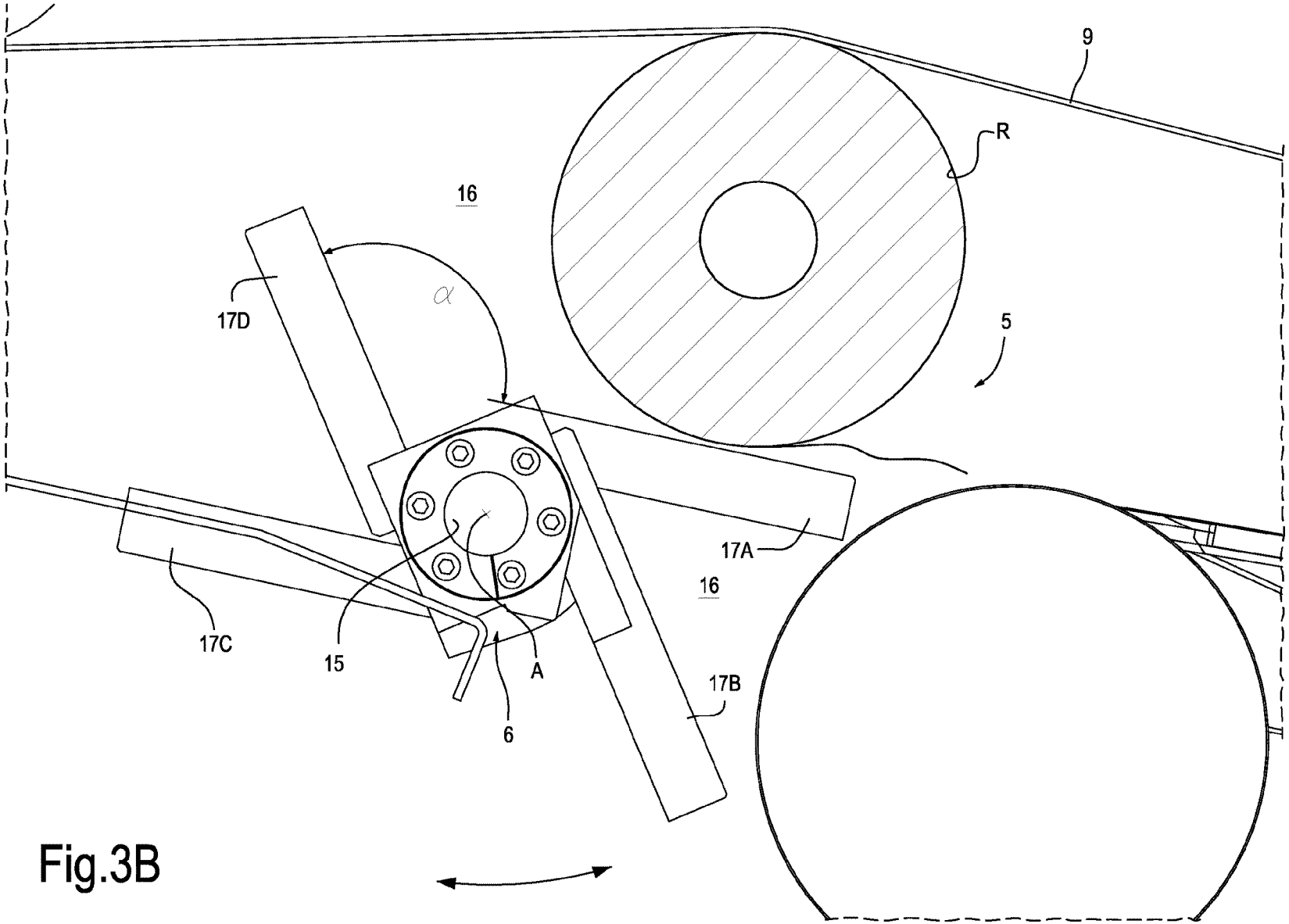

FIGS. 2 and 3A, 3B show, in a schematic side view, the loading device 5 in two different configurations according to the diameter of the rolls R to be processed. In the embodiment shown in FIGS. 2 and 3A, 3B the loading device 5 comprises a rotating member 6, comprising a shaft 15, which rotates around an axis A of rotation, parallel to the axis of the rolls R which advance along the feeding path P. Radial elements 17A, 17B, 17C, 17D are fixed to the shaft 15. In the configuration of FIGS. 1 and 2, the radial elements 17A, 17B 17C, 17D are orthogonal to each other, namely they are arranged offset by 90° with respect to each other. As it can be understood from these figures, the elements 17A, 17B 17C, 17D are radial in the sense that they extend orthogonally to the direction defined by the axis A of rotation of the loading device 5, but do not pass from the axis A of rotation, but they are placed laterally with respect to it. As defined above, the term "radial" in the present context also includes this arrangement.

The configuration of FIGS. 1 and 2 allows the loading device 5 to distribute individual rolls R that arrive on the chute 3 towards the portion of the advancement path P downstream of the device 5, that is towards the gluing station 7. For this purpose the loading device 5 rotates clockwise (in the figure), according to the arrow (FIG. 2) for example by means of an actuator schematically indicated with 14 in FIG. 1. The actuator 14 can comprise an electric motor and can be interfaced to a control unit 8, which can be equipped with one or more user interfaces 10. The rotation is in 90° steps, so that the device 5 loads, i.e. distributes, at each step a single roll R towards the advancement zone defined between the two continuous members 9, 11. The rotation rate, which is normally intermittent, depends on the production rate of the closing machine 1 of the free end of the rolls. This cadence is given by the speed with which the operations on the rolls R are performed. In particular, in a per se known manner, the free edge L to be closed (FIG. 1) must be correctly positioned in the first section of the path between the continuous flexible organs 9, 11 and within gluing station 7 the adhesive must be applied to the roll and the free edge L must be rewound onto the roll.

Normally, as shown in FIG. 1, there are several rolls in the machine to simultaneously perform the various operations on rolls in sequence. In the accumulation zone 12, rolls R can be stored waiting to be picked up by the device 5 and conveyed to the gluing station 7.

This accumulation zone makes possible, at least in part, to release the production speed of the upstream machines (for example a rewinder) from the production speed of the gluing machine 1.

FIG. 2 shows rolls of two different diameters; one is indicated with R in a continuous line; the other of greater diameter is shown in hatch and it is indicated with RX. For larger diameters of the RX roll it is normally necessary to modify the layout of the loading device as in FIGS. 3A, 3B.

When the diameter of the rolls R is such that they can no longer be manipulated by the device 5 in the layout of FIGS. 1 and 2, it can be expected that at least one of the radial elements 17A, 17B, 17C, 17D will assume a different angular position, forming an angle greater than 90° with the element upstream (with respect to the direction of rotation).

In the embodiment of FIGS. 1-3B, the radial elements 17A, 17B, 17C, 17D are arranged in pairs, in the sense that the radial element 17A is rigidly connected to the radial element 17C, while the radial element 17B is rigidly connected to the radial element 17D. The two pairs of radial elements 17A, 17C and 17B, 17D are angularly offset with respect to each other, as can be understood by comparing FIGS. 2, 3A, 3B, in which the two different angular positions, assumable by the radial elements 17A-17D, are shown. In FIG. 2, they are oriented so as to form four receiving seats 16 of the rolls R, each delimited by two adjacent radial elements at 90° to each other. In FIGS. 3A, 3B, on the other hand, two receiving seats 16 of the rolls R are formed, each having an opening a greater than 90°, for example equal to or greater than 120°, preferably lower than 180°, for example between 120° and 170°. The large diameter rolls can be received in these receiving seats 16 of angle greater than 90°.

In the layout of FIGS. 3A, 3B, the device 5 can be equipped with an alternate rotation movement, according to the double arrow indicated in the figure, or with a clockwise oriented continuous rotation movement. The choice of the motion type can be a function of the roll diameter and it can be simply made by acting on the control unit 8 of the motor 14.

For a better understanding of the operation of the loading device when configured to handle rolls of greater diameter, FIGS. 3A, 3B show two distinct angular positions of the device. In FIG. 3A the loading device 5 receives a new roll from the upstream machine. In FIG. 3B the loading device 5 has been rotated by an angle sufficient enough to move the seat, which received the roll, into an unloading position towards the gluing station. The subsequent movement can be a rotation reverse to the one that moved from the position of FIG. 3A to the position of FIG. 3B, so as to position the loading device 5 again in a position suitable for receiving a new roll. Motion is therefore an alternating rotation motion.

It will be understood from what has been described that by simply modifying the angular arrangement of the radial elements 17A, 17B, 17C, 17D the device 5 can be adapted to the diameter of the rolls R, allowing the device 5 to pass from the handling of rolls of small diameter (FIGS. 1, 2, for example rolls of toilet paper or kitchen towels for domestic use) to the processing of large diameter rolls (FIG. 3A, 3B; for example, so-called industrial rolls). The intervention and set-up times of machine 1 are very limited, with a consequent reduction in machine downtime.

In some embodiments, the transition from one configuration to the other can be performed manually. In other embodiments, an automated configuration change system can be provided.

Figure 4:
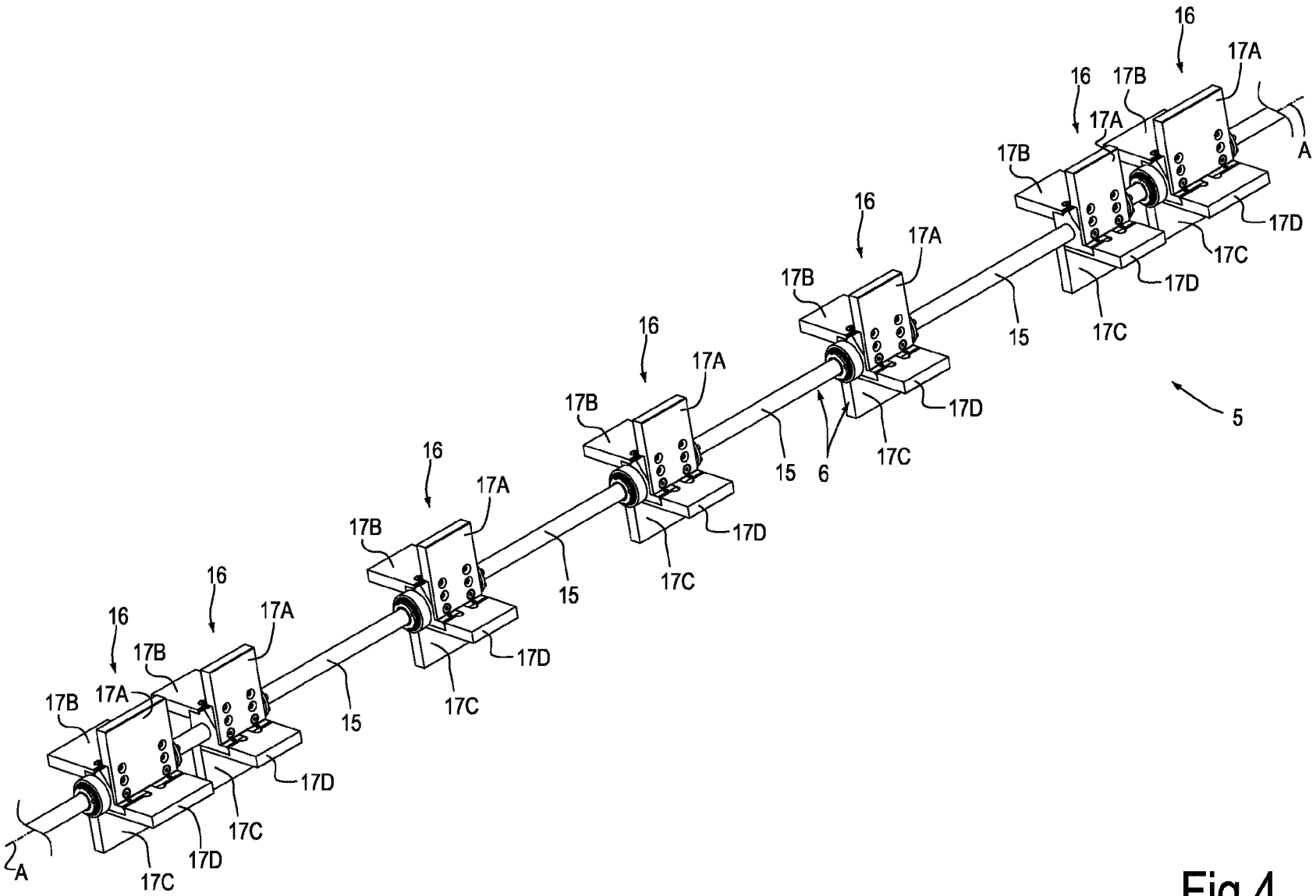
FIG. 4 shows an axonometric view of a device in a second embodiment and in a first working configuration.
Figure 5:
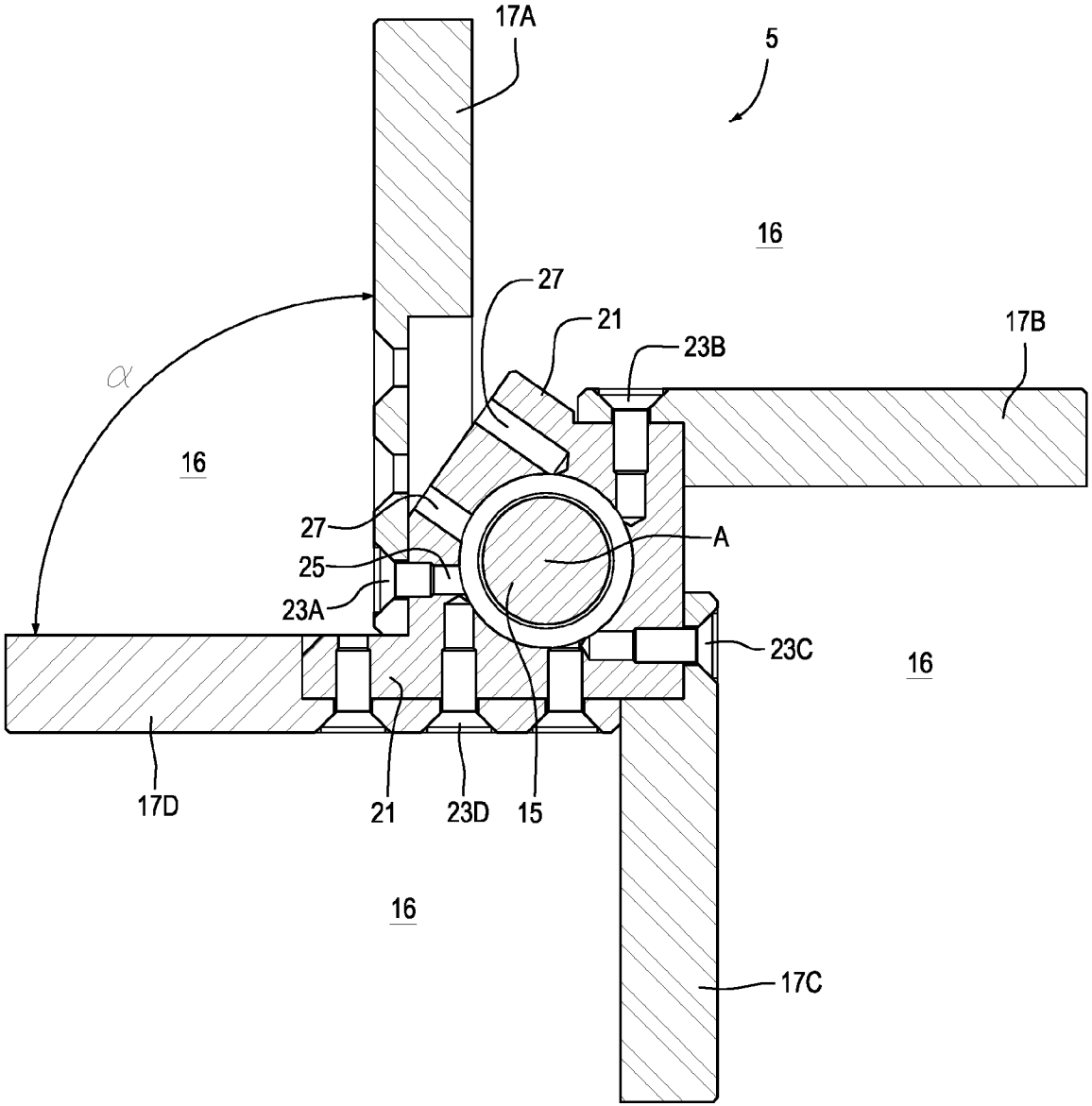
FIG. 5 shows a section of a group of radial elements of FIG. 4 according to a plane orthogonal to the axis of rotation.
Figure 6:
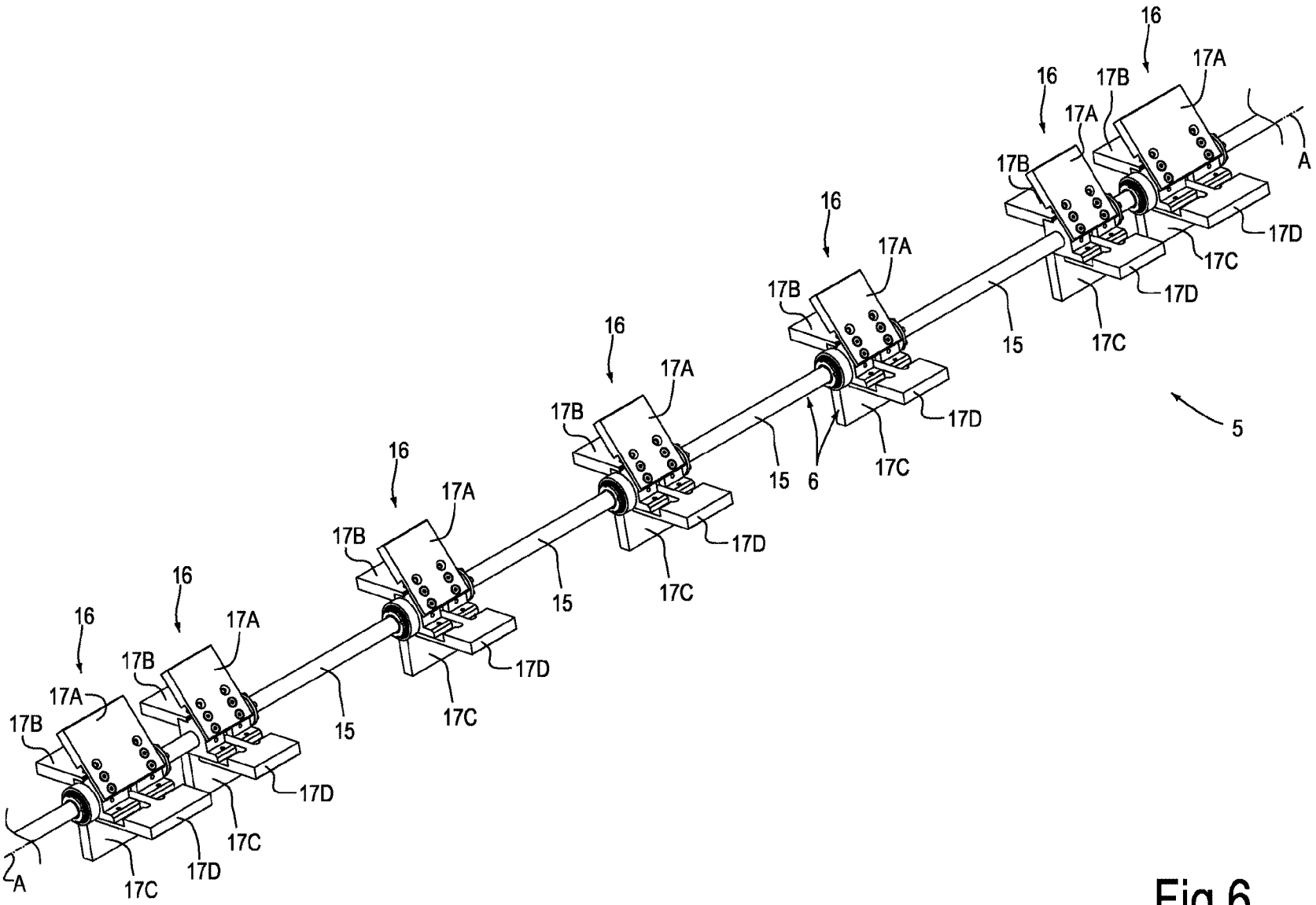
FIG. 6 shows an axonometric view similar to FIG. 4, in a different working configuration.
Figure 7:
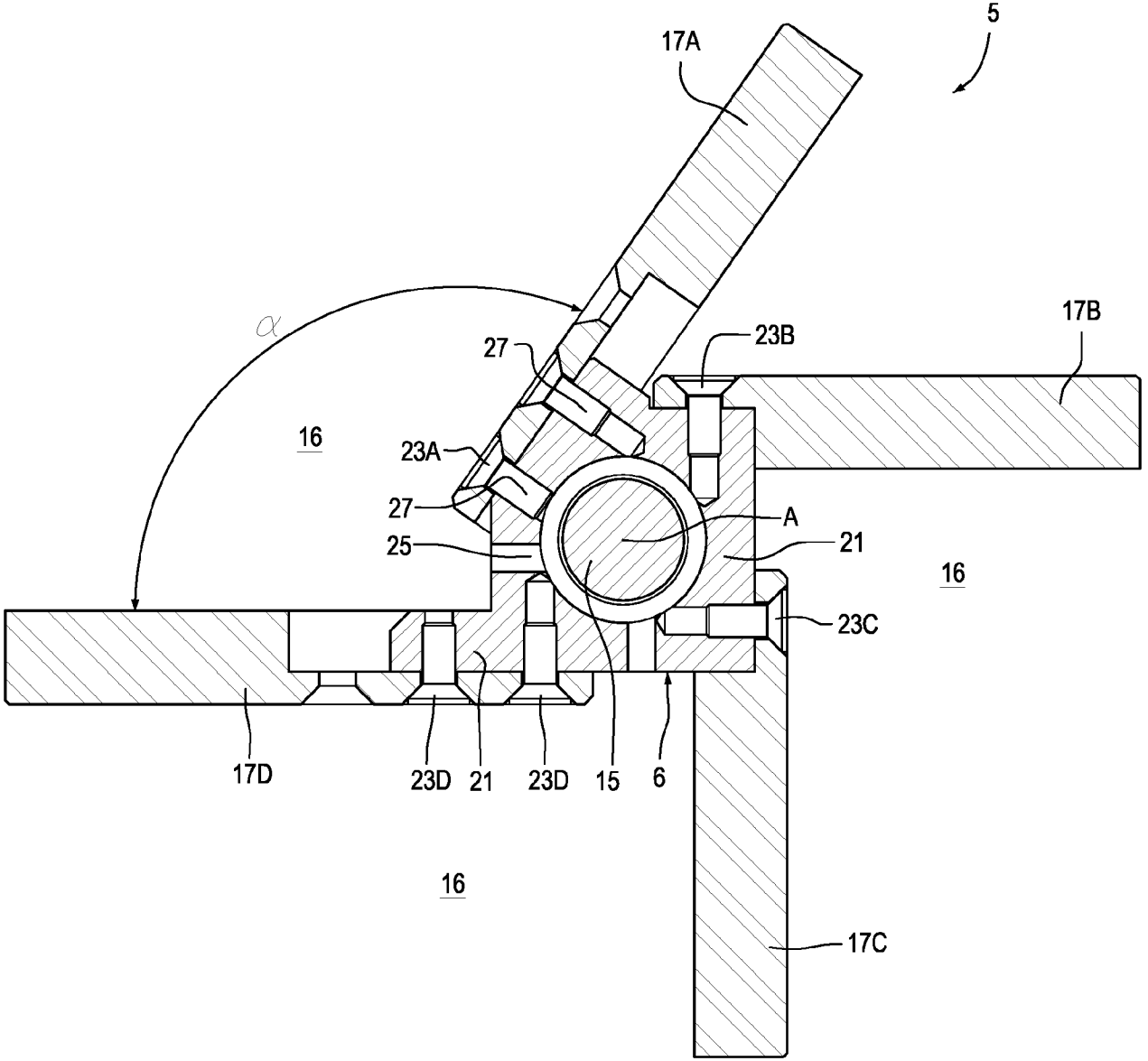
FIG. 7 shows a section of FIG. 6 similar to the section of FIG. 5.

FIGS. 4-7 show a simplified and particularly economical embodiment of the device 5. FIGS. 4 and 5 show a first configuration and FIGS. 6 and 7 show a second configuration of the loading device 5. Equal numerals indicate parts that are the same or equivalent to those already described with reference to FIGS. 1-3.

These figures show that in reality the device 5 can comprise more than one series or group of the radial elements 17A, 17B, 17C, 17D, distributed along the axial development of the shaft 15. In particular, FIGS. 4 and 6 show an axonometric view of a loading device 5, with several series of the radial elements 17A, 17B, 17C, 17D that occupy various positions along the shaft 15. Each group or set of the radial elements 17A, 17B, 17C 17D is indicated by 16.

The radial elements of the various groups 16 are aligned with each other, so that corresponding radial elements of the various groups form together respective receiving seats 16 of the rolls R.

As can be seen in particular in FIGS. 5 and 7, each group 16 of radial elements 17A-17D comprises a support block 21 keyed onto the shaft 15, i.e. rigidly connected to the shaft 15 to rotate with it. The various radial elements 17A, 17B, 17C, 17D are fixed to the support block 21 by means of respective screws, indicated by 23A, 23B, 23C, 23D, respectively, which engage in corresponding threaded holes of the support block 21. Each of the radial elements 17B, 17C, 17D is applied to the support block 21 at a contact surface, which defines a single position of the respective radial element. On the other hand, the radial element 17A can be fixed to the support block 21 in two distinct angular positions, visible in FIGS. 5 and 7. In FIG. 5 the radial element 17A is fixed to the support block 21 by means of a screw 23A engaged in a threaded hole 25 and is in a position such as to form an angle $\alpha$ of about 90° with the adjacent radial element 17D. In FIG. 7, instead, the radial element 17A is mounted by means of screws 23A engaging in threaded holes 27 of the support block 21, so as to form with the adjacent radial element 17D an angle $\alpha$ substantially greater than 90°, for example of about 120°.

In the configuration of FIGS. 4 and 5, the loading device 5 forms four receiving seats 16 of the same shape for feeding single rolls R of reduced diameter, for example rolls of toilet paper or kitchen towel-paper for domestic use. The device 5 can always rotate in the same direction, by steps according to the frequency with which the rolls R must be loaded into the machine 1.

In the assembly of FIGS. 6 and 7, vice versa, the loading device 5 has a single receiving seat 16 useful for loading the rolls R, constituted by the radial elements 17D, 17A and can rotate by alternate motion to load single rolls R of large diameter, for example rolls of kitchen towels for industrial use, in the machine 1.

The embodiment of FIGS. 4-7 is particularly simple in that it allows passing from one configuration to another simply by unscrewing and re-tightening the screws 23A with which the radial elements 17A are fixed. No type of actuator is required to switch between the two configurations. The maximum constructive simplicity carries the disadvantage of a longer time to convert the machine from one to the other of the two arrangements.

Figure 8:
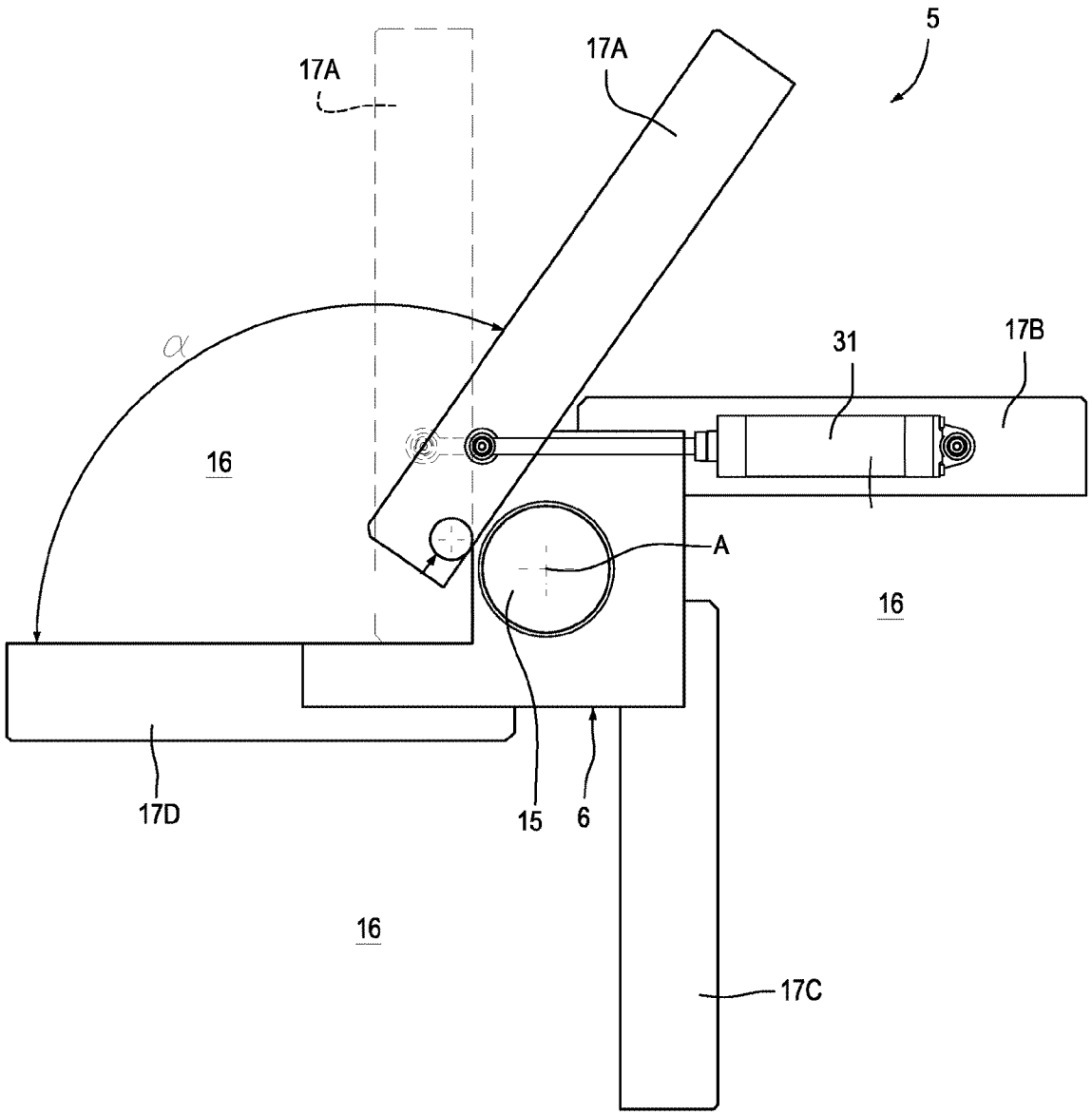
FIG. 8 shows a third embodiment.

In other embodiments, on the other hand, it may be expected that the change of configuration would be carried out by means of an actuator, which can be controlled by the control unit 8 by means of commands given for example through the user interface 10. FIG. 8 shows a cross section of the device 5 in an embodiment in which the radial element 17A is actuated by an actuator 31, so that it can be moved alternately into one or the other of at least two different angular positions. More particularly, in FIG. 8 the actuator is a linear cylinder-piston actuator, connected to the radial elements 17B and 17A. The radial element 17A can assume the two angular positions indicated with a continuous line and a dashed line, for handling rolls of large diameter and small diameter, respectively. The components of the device 5 remain substantially the same as those previously described and marked with the same reference numerals. Instead of a linear cylinder-piston actuator, a rotary actuator, or any other suitable device can be provided.

In still other embodiments it can be provided that at least one of the radial elements 17A-17D is rotatably mounted and lockable on the shaft 15 in at least two distinct angular positions, and that the movement from one to the other of these positions takes place manually. For example, it can be expected to release an angular clamping member of the mobile radial element, angularly moving the mobile radial element and locking it again at the modified angular position.

While in the embodiments described above the configuration modification of the device 5 is obtained by varying the angular position of one of the radial elements 17A-17D, in other embodiments it is possible to modify the configuration of the receiving seats 16 of the rolls R by replacing at least one of the radial elements.

Figure 9:
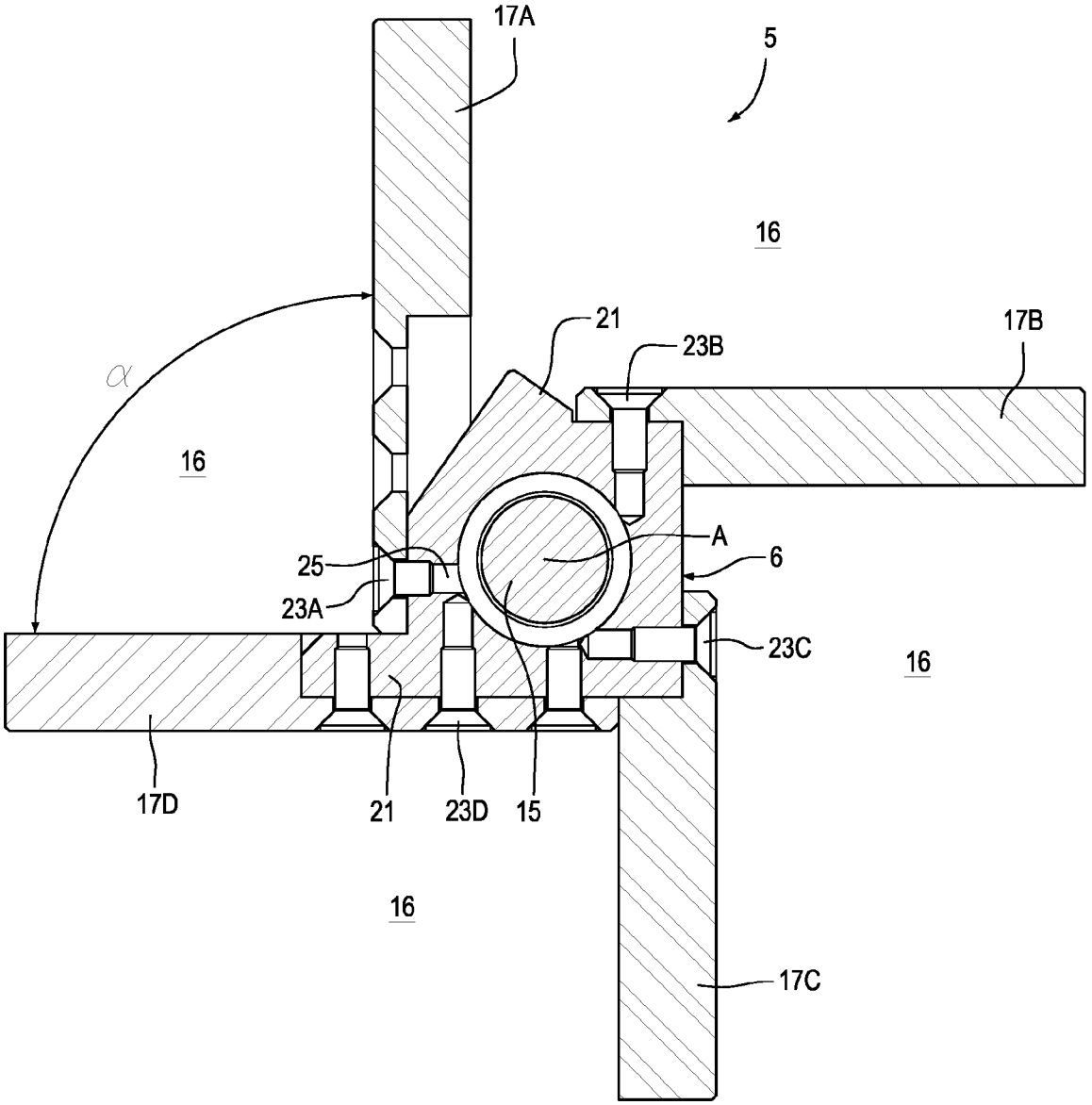
FIGS. 9 and 10 show another embodiment of a device according to the invention in two different usage modes.
Figure 10:
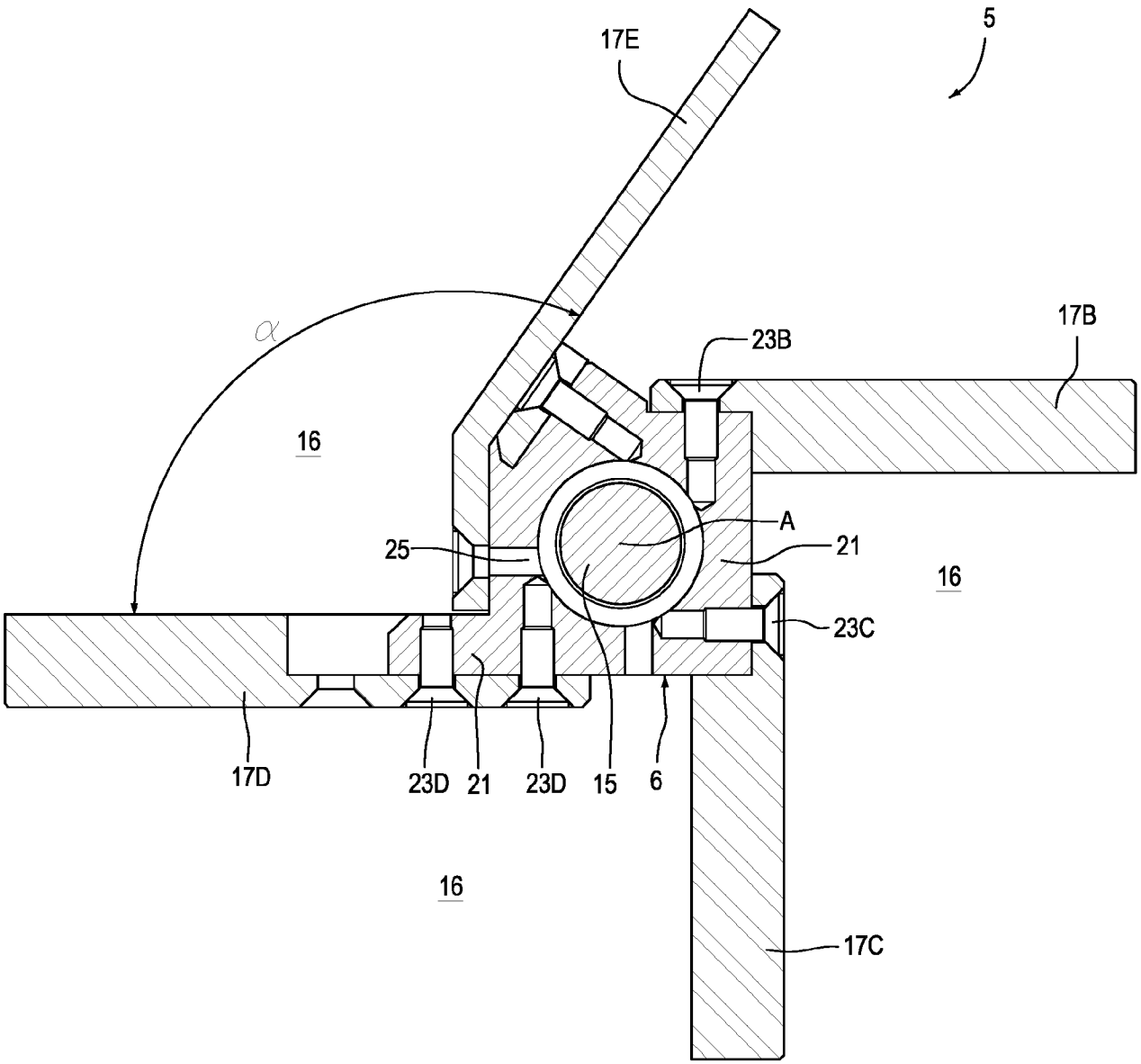

FIGS. 9 and 10 show an embodiment of this type in a transverse section. Equal numerals indicate equal or equivalent parts to those described with reference to the preceding figures. The main difference between FIGS. 9, 10 and FIGS. 4-7, 8 consists mainly in the fact that the radial element 17A is replaceable with a radial element 17E of different shape, instead of being assembled in two different angular positions or assembled in two different angular positions. More particularly, the layout on FIG. 9 is substantially the same as in FIG. 5, while in FIG. 10 the replaceable radial element 17A has been replaced with an alternative radial element 17E. By possibly using the same anchoring elements of the radial element 17A, said alternative radial element 17E is shaped in such a way that the receiving seat 16 formed by it has a greater opening angle. For this purpose, as shown in the drawing, the alternative radial element 17E can be provided with an inclined portion.

The embodiment of FIGS. 9 and 10 may be less advantageous, since it requires an alternative element 17E which constitutes an additional element of the device 5.

The invention claimed is:

1. A device for loading rolls (R) in a machine (1), comprising a rotating member (6) for rotating around an axis (A) of rotation and having a plurality of radial elements (17A, 17B, 17C, 17D; 17E) angularly spaced with respect to each other, which define receiving seats (16) for rolls; at least one of said receiving seats (16) is configurable into at least two distinct configurations for receiving and handling rolls (R) of different radial dimensions; said plurality of radial elements comprising a plurality of pairs of radial elements (17A, 17B, 17C, 17D), wherein at least one of said radial elements (17A, 17B, 17C, 17D; 17E) is a replaceable radial element (17A) that is replaceable with an alternative radial element (17E), the replaceable radial element and the alternative radial element having different geometrical shapes, such that the at least two distinct configurations correspond to the replaceable radial element and the alternative radial element alternatively mounted on the rotating member (6) define respective receiving seats (16) of different angular openings for receiving and handling rolls of different sizes.

2. The device according to claim 1, wherein the replaceable radial element (17A) and the alternative radial element (17E) have different geometrical shapes, such that when mounted they are arranged one at about 90° with respect to an adjacent radial element, and the other with an angle greater than 90° with respect to said adjacent radial element.

3. The device according to claim 2, wherein said angle greater than 90° ranges between 120° and 180°.

4. The device according to claim 1, comprising four radial elements (17A, 17B, 17C, 17D) arranged at 90° with respect to each other in a first configuration of the receiving seats (16) of the rolls (R), and wherein at least one first radial element (17A) of said four radial elements (17A, 17B, 17C, 17D) is adapted to assume a second position, in which it forms an angle greater than 90° with one of the radial angularly adjacent elements.

5. The device according to claim 4, wherein a second radial element of said four radial elements (17A, 17B, 17C, 17D), substantially symmetrical to the first radial element with respect to the axis (A) of rotation, is angularly movable to assume a position, in which it forms an angle greater than 90°, with an angularly adjacent radial element.

6. The device according to claim 5, wherein the first radial element and the second radial element are integral with each other and rotate integrally with each other around the axis (A) of rotation.

7. The device according to claim 4, further comprising an actuator member (31) for modifying geometry of the receiving seats (16) of rolls (R).

8. The device according to claim 4, further comprising a shaft (15) rotating around the axis (A) of rotation and a support block (21) for supporting the plurality of radial elements (17A, 17B, 17C, 17D; 17E), rigidly connected to the shaft (15) and rotating with it; wherein the support block (21) comprises, for at least one of said radial elements (17A, 17B, 17C, 17D; 17E), constraint members (27) configured so as to allow said radial element to be fixed in at least two angularly different positions with respect to the shaft (15).

9. The device according to claim 4, further comprising a shaft (15) rotating around the axis (A) of rotation and a support block (21) for supporting the radial elements (17A, 17B, 17C, 17D), rigidly connected to the shaft (15) and rotating with it; wherein the support block (21) comprises, for at least one radial element (17A) of said radial elements (17A, 17B, 17C, 17D), constraint members (27) configured so as to allow an angular rotation of the at least one radial element (17A) with respect to the shaft (15) and to allow the attachment of said at least one radial element in at least two different angular positions with respect to the shaft (15).

10. A machine comprising a feeding path (P) of rolls (R) from an inlet (2) inside the machine, with said machine (1) being characterized in that it comprises a device (5) according to claim 1, positioned along the feeding path (P).

11. The machine according to claim 10, comprising an actuator (14) to rotate said device (5); said actuator comprising an electric motor.

12. The machine according to claim 11, wherein said actuator member (14) rotates the device (5) with continuous rotary motion or with alternating rotary motion, according to a geometry of the receiving seats (16) of the rolls (R).

13. The machine according to claim 10, configured to close a free edge of said rolls and comprising a station for closing the rolls along the feeding path (P) and downstream of the device with respect to the feed direction of rolls.

14. The machine according to claim 10, comprising, upstream of the device (5), a zone (12) for accumulating the rolls.

* * * * *